US005362561A

United States Patent [19]

Lower

[11] Patent Number: 5,362,561

[45] Date of Patent: Nov. 8, 1994

[54] ORNAMENTAL PROMOTIONAL ARTICLE

[76] Inventor: W. Richard Lower, 2144 Memorial Ct., Kingsport, Tenn. 37664

[21] Appl. No.: 160,046

[22] Filed: Nov. 30, 1993

[51] Int. Cl.[5] ..... B65D 51/12; B65D 23/12; B65D 23/14

[52] U.S. Cl. ..... 428/343; 215/100 R; 215/100.5; 40/310; 40/311; 229/89

[58] Field of Search ..... 215/100 R, 100.5; 40/310, 311; 229/89, 90, 91; 206/457; 428/343

[56] References Cited

U.S. PATENT DOCUMENTS

| | | | |
|---|---|---|---|
| 2,040,381 | 5/1936 | Hull | 40/311 X |
| 2,079,757 | 5/1937 | Berk | 40/311 X |
| 2,112,477 | 3/1938 | Brownfield | 229/89 X |
| 2,263,122 | 11/1941 | DeHaven | 229/89 X |
| 3,196,567 | 7/1965 | Boehmer et al. | 215/100 R |
| 3,382,779 | 5/1968 | Lynas | 40/310 X |
| 3,831,300 | 8/1974 | Berkhouse | 40/310 |
| 4,227,327 | 10/1980 | Thompson | 40/311 X |
| 4,635,291 | 1/1987 | Barton | 215/100 R X |
| 4,811,896 | 3/1989 | Sohma | 229/89 |

*Primary Examiner*—Daniel R. Zirker

[57] ABSTRACT

An attachment item for affixing an ornamental, promotional article to a container neck, the item having a thin, flexible, elongated body adapted for lengthwise wrapping around the neck of a container with its ends in overlapping relationship and with its inner surface lying contiguous the neck, the body when so wrapped having a generally cylindrical shape and a longitudinal axis, a Fastening device on the inner surface of the body adjacent at least one of its ends and adapted for contacting a portion of the outer surface of the body proximate the other of its ends to become affixed thereto for holding the body in a generally cylindrical shape around the neck, a flap affixed by a hinge to the body along a portion of the top edge thereof, the hinge allowing the flap to lie in substantially the same plane as the body when the body is in a flat blank condition and to allow the flap to lie in a plane oriented substantially normal to the longitudinal axis of the cylinder when the body is wrapped around the neck with the outer surface of the flap facing generally longitudinally outwardly of the neck, the outer surface of the flap being adapted to provide a support for affixing an ornament to the item.

11 Claims, 1 Drawing Sheet

ORNAMENTAL PROMOTIONAL ARTICLE

FIELD OF THE INVENTION

This invention concerns a promotional or advertising article for use particularly on beverage bottles or the like which have a pouring neck. e.g., liquor bottles.

BACKGROUND OF THE INVENTION

Heretofore, ornamental promotional articles such as bows, flowers or the like have been affixed to bottles or other such containers, for example, by sticking or otherwise affixing the article to the side or other portions of the bottle whereby the bottle has to be faced in a certain direction in order to properly present the ornament to the viewer. Also, sticking of the ornament to the bottle, or tying it thereto can hinder its removal and damage it for reuse.

A principal object of the present invention is to provide a simple end expedient attachment item for affixing, preferably in a readily removable manner, an ornament such as a colorful bow or the like to the top port ion of a bottle such that the ornament extends upwardly from the top of the bottle and thus is highly visible to a customer when viewed from any direction.

BRIEF DESCRIPTION OF THE INVENTION

This and other objects hereinafter appearing have been attained in accordance with the present invention which is defined as an attachment item for affixing an ornamental, promotional article to a container neck, said item comprising a thin, flexible, elongated body means having top and bottom edges, opposite ends, outer and inner surfaces and having s substantial width between said top and bottom edges, said body means being adapted for lengthwise wrapping around the neck of a container with said ends in overlapping relationship and with said inner surface lying contiguous said neck, said body means when so wrapped having a generally cylindrical shape and a longitudinal axis, fastening means of said inner surface of said body means at least adjacent one of said ends and adapted for contacting said neck or a portion of said outer surface of said body means proximate the other of said ends to become affixed thereto for holding said body means in said generally cylindrical shape around said neck, flap means affixed by hinge means to said body means along a portion of said top edge thereof and having outer and inner surfaces, said hinge means being adapted to allow said flap means to lie in substantially the same plane as said body means with said outer and inner surfaces of each juxtaposed when said body means is in a flat blank condition and to allow said flap means to lie in a plane oriented substantially normal to said longitudinal axis when said body means is wrapped around said neck with the outer surface of said flap means facing generally longitudinally outwardly of said neck, said outer surface of said flap means being adapted to provide a support for affixing an ornamental article to said item.

In certain preferred embodiments:

(a) said hinge means is integrally formed with said body means and said flap means;

(b) said fastening means is selected from the group consisting of adhesive means, Velcro means, or interfitting tab means;

(c) said ornamental means has a generally bow-like configuration; and (d) said fastening means comprises an adhesive strip on the inner surface of said body means adjacent one end thereof,

BRIEF DESCRIPTION OF THE DRAWINGS

The invention will be further understood from the drawing herein and description, of preferred embodiments, wherein the various figures are not necessarily drawn to scale and certain dimensions are enlarged for clarity.

DETAILED DESCRIPTION OF THE DRAWING

Figure 1:
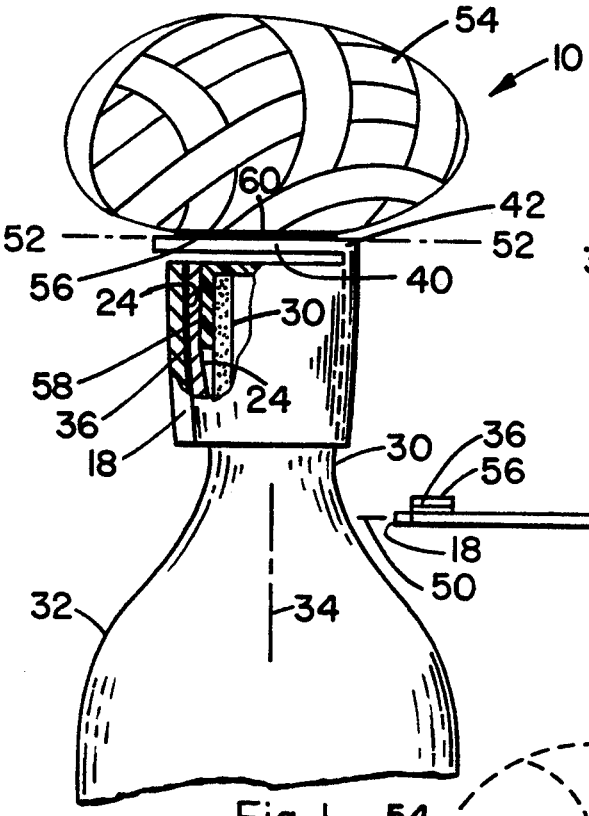
FIG. 1 is a side view of a bottle with the present ornamental article supporting item affixed to the neck thereof.
Figure 4:
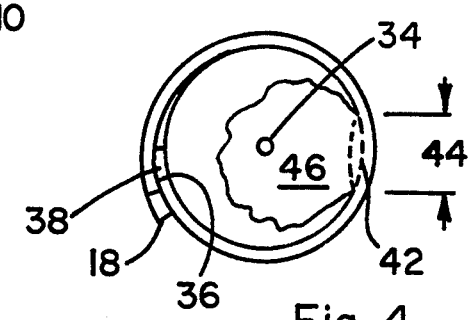
FIG. 4 is a top view of FIG. 1, partially in section and of enlarged thickness of the body means and flap means, with only a portion of the flap means shown and the bow removed.
Figure 5:
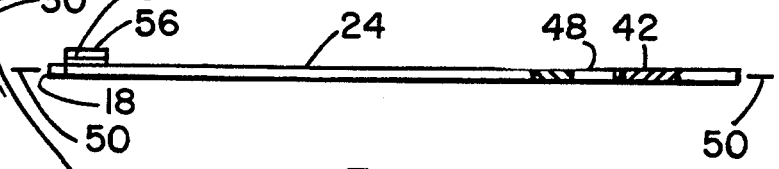
FIG. 5 is an edge view of the item shown in FIG. 2 taken in the direction of line "5" in FIG. 2 with portions of the body means broken away to show portions of the flap means and hinge means.
Figure 2:
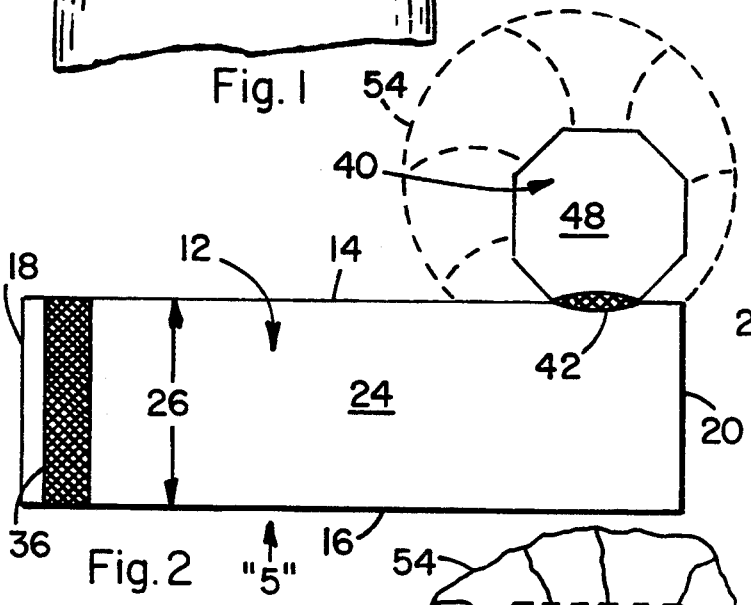
FIG. 2 is an elevational view of the inner surface of the item with a bow shown in outline as affixed to the outer surface of the flap means.

Referring to the drawing and with particular reference to the claims hereof, the present attachment item for affixing an ornamental, promotional article to a container neck, is generally designated 10 and comprises a thin, flexible, elongated body means 12 having top 14 and bottom 16 edges, opposite ends 18, 20, outer and inner surfaces 22, 24 and having a substantial width 26 between said top and bottom edges, said body means 12 being adapted for lengthwise 28 wrapping around the neck 30 of a container 32 with said ends 18, 20 in overlapping relationship and with said inner surface 24 lying contiguous said neck, said body means when so wrapped having a generally cylindrical shape and a longitudinal axis 24, fastening means 36 on said inner surface 24 of said body means 12 at least adjacent one of said ends and adapted for contacting said neck or a portion 38 of said outer surface of said body means proximate the other of said ends to become affixed thereto for holding said body means in said generally closed cylindrical shape around said neck, flap means 40 affixed by hinge means 42 to said body means along a portion 44 of said top edge thereof and having outer 46 and inner 48 surfaces, said hinge means 42 being adapted to allow said flap means to lie in substantially the same plane 50 as said body means with said outer and inner surfaces of each juxtaposed when said body means is in a flat blank condition and to allow said flap means to lie in a plane 52 oriented substantially normal to said longitudinal axis when said body means is wrapped around said neck with the outer surface of said flap means facing generally longitudinally outwardly of said neck, said outer surface of said flap means being adapted to provide a support for affixing an ornamental article 54 to said item.

The body means, flap means and hinge means of the present article are preferably formed integrally by cutting out or press blanking of thin cardboard or other paper-like material or plastic sheet, preferably of a thickness of from about 5 to about 15 mil in order to be easily handled and to give proper strength and rigidity thereto for supporting the bow or other such ornament, and to be readily reusable if desired. The fastening means 36 is preferably of adhesive material covered by a protective pealable strip 56 as is well known in the art. The end 18 may be extended beyond adhesive material 36 such that it can be finger gripped and pealed off of portion 38 if desired for removing the article from the bottle.

Figure 6:
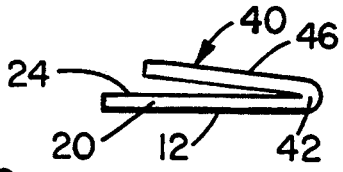
FIG. 6 is an end view of the item of FIG. 2 showing the creasing of the flap means about the hinge means in preparation for affixing the item to a bottle neck as shown in FIG. 1.
Figure 3:
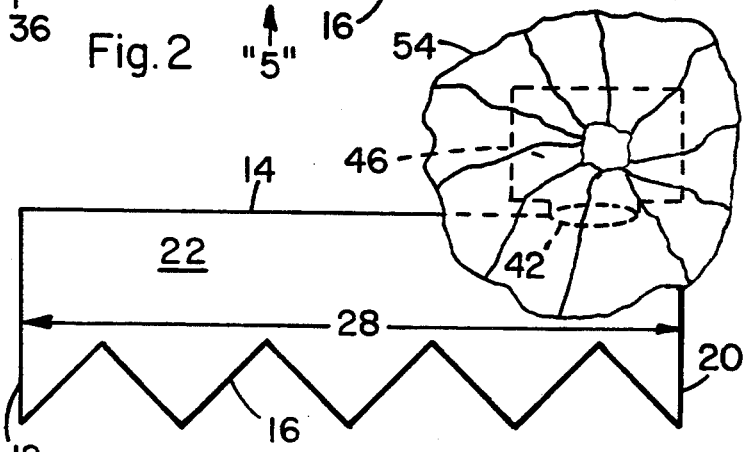
FIG. 3 is a mirror image elevational view of the outer surface of a variation in shape of the item of FIG. 2, with the bow shown affixed to the outer surface of the flap means.

The size and shape of the body means and flap means can be widely varied to fit various size bottles or other containers, and the term "cylindrical" as used herein encompases round, oblong, square or the like for accommodating the many shapes and configurations of container necks. Also, the flap means can be positioned at any point along the upper edge 14 of the body means In use, the flap means 40 is simply creased, preferably overcreased, along the hinge means 42 as shown in FIG. 6 to ensure that the flap will remain substantially planar with the top of the bottle cap 58. The ornament 54 such as a bow may then be affixed by an adhesive stick pad such as 60, or by any other means including Velcro or stapling, to the outer surface of the flap means, the protective pealable strip 56 removed and the body means 12 then wrapped around the bottle neck and cap 58 and the adhesive fastening means 36 then pressed against portion 38 of the outer surface 22 of the body means to hold the article firmly on the bottle neck with the flap means and ornament postured in an attractive and highly visible position overlying the top of the bottle cap. The ornament may, of course, be affixed to the flap means after the attachment item is affixed to the bottle neck. It is noted that as shown in FIG. 1, a gap between the inner side of the flap means and the top of cap 58 is shown for purposes of clarity. In actual use, no such gap is necessary.

Figure 7:
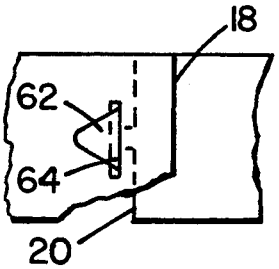
FIG. 7 is a side view of the item of FIG. 1 showing the ends connected by cooperating tab means and slot means.

As shown in FIG. 7, end 20 of the body means may be provided with a tab such as 62 for insertion through a slot 64 in a portion of end 18 for locking the item around the bottle neck. As aforesaid, any fastening means may be employed in the present invention, although the adhesive strip 38 or adhesive material coated onto at least a substantial portion of surface 24 such as to contact the bottle neck where desired for certain applications is much preferred. It is noted that if desired, an adhesive fastening means such as 36 and 56 may be provided on surface 48 of the flap means to ensure a more positive flat posture for the flap means.

The invention has been described in detail with particular reference to preferred embodiments thereof, but it will be understood that variations and modifications will be affected with the spirit and scope of the invention.

I claim:

1. An attachment item for affixing an ornamental, promotional article to a container neck, said item comprising a thin, flexible, elongated body means having top and bottom edges, opposite ends, outer and inner surfaces and having a substantial width between said top and bottom edges, said body means being adapted for lengthwise wrapping around the neck of container with said ends in overlapping relationship and with said inner surface lying contiguous said neck, said body means when so wrapped having a generally cylindrical shape about a longitudinal axis, fastening means on said inner surface of said body means at least adjacent one of said ends and adapted for contacting said neck or a portion of said outer surface of said body means proximate the other of said ends to become affixed thereto for holding said body means in said generally closed cylindrical shape around said neck, flap means affixed by hinge means to said body means along a portion of said top edge thereof and having outer and inner surfaces, said hinge means being adapted to allow said flap means to lie in substantially the same plane as said body means with said outer and inner surfaces of each juxtaposed when said body means is in a flat blank condition and to allow said flap means to lie in a plane oriented substantially normal to said longitudinal axis when said body means is wrapped around said neck with the outer surface of said flap means facing generally longitudinally outwardly of said neck, said outer surface of said flap means being adapted to provide a support for affixing an ornamental article to said item.

2. The article of claim 1 wherein said hinge means is integrally formed with said body means and said flap means.

3. The article of claim 2 wherein said fastening means is selected from the group consisting of adhesives means, Velcro fasteners, or interfitting tab means.

4. The article of claim 3 wherein said ornamental means has a generally bow-like configuration.

5. The article of claim 4 wherein said fastening means comprises an adhesive strip on the inner surface of said body means adjacent one end thereof.

6. An ornamental, promotional article for attachment to a container neck, said article comprising an attachment item comprising a thin, flexible, elongated body means having top and bottom edges, opposite ends, outer and inner surfaces and having a substantial width between said top and bottom edges, said body means being adapted for lengthwise wrapping around the neck of a container with said ends in overlapping relationship and with said inner surface lying contiguous said neck, said body means when so wrapped having a generally cylindrical shape about a longitudinal axis, fastening means on said inner surface of said body means at least adjacent one of said ends and adapted for contacting said neck or a portion of said outer surface of said body means proximate the other of said ends to become affixed thereto for holding said body means in said generally closed cylindrical shape around said neck, flap means affixed by hinge means to said body means along a portion of said top edge thereof and having outer and inner surfaces, said hinge means being adapted to allow said flap means to lie in substantially the same plane as said body means with said outer and inner surfaces of each juxtaposed when said body means is in a flat blank condition and to allow said flap means to lie in a plane oriented substantially normal to said longitudinal axis when said body means is wrapped around said neck with the outer surface of said flap means facing generally longitudinally outwardly of said neck, and ornament means affixed to said outer surface of said flap means.

7. The article of claim 6 wherein said hinge means is integrally formed with said body means and said flap means.

8. The article of claim 7 wherein said fastening means is selected from the group consisting of adhesives, Velcro fastener, or interfitting tab means.

9. The article of claim 8 wherein said ornament means has a generally bow-like configuration.

10. The article of claim 9 wherein said fastening means comprises an adhesive strip on the inner surface of said body means adjacent one end thereof.

11. A container having the article of claim 6 affixed to the neck thereof with the ornament means overlying the top of the container.

* * * * *

UNITED STATES PATENT AND TRADEMARK OFFICE

CERTIFICATE OF CORRECTION

PATENT NO. : 5,362,561

DATED : November 8, 1994

INVENTOR(S) : W. Richard Lower

It is certified that error appears in the above-identified patent and that said Letters Patent is hereby corrected as shown below:

Column 1, line 20, delete "end" and insert ---and---;
line 22, delete "port" and insert ---por- ---;
line 23, delete "ion" and insert ---tion---;
line 34, delete "s" and insert ---a---;
line 42, delete "of" first occurrence and insert ---on---;

Column 2, line 4, delete the comma and insert a period;
line 51, delete "24" and insert ---34---;

Column 3, line 24, insert a period at the end of the sentence;
line 50, delete "38" and insert ---36---;

Column 4, line 1, after "of" insert ---a---;

In the Abstract line 9, delete "Fastening" and insert ---fastening---.

Signed and Sealed this

Fourth Day of April, 1995

Bruce Lehman

*Attest:*

BRUCE LEHMAN

*Attesting Officer*

*Commissioner of Patents and Trademarks*